US009139781B2

(12) United States Patent
Bernatz et al.

(10) Patent No.: US 9,139,781 B2
(45) Date of Patent: Sep. 22, 2015

(54) DELAYED COKING PROCESS

(75) Inventors: Fritz A. Bernatz, Clifton, VA (US); Michael Siskin, Westfield, NJ (US); Christopher P. Eppig, Saint Charles, IL (US); Craig Y. Sabottke, Slidell, LA (US); Eric W. Fryatt, New Orleans, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1182 days.

(21) Appl. No.: 12/828,405

(22) Filed: Jul. 1, 2010

(65) Prior Publication Data

US 2011/0005911 A1 Jan. 13, 2011

Related U.S. Application Data

(60) Provisional application No. 61/270,595, filed on Jul. 10, 2009.

(51) Int. Cl.

| | |
|---|---|
| ***C10G 9/14*** | (2006.01) |
| ***C10G 9/34*** | (2006.01) |
| ***C10G 9/00*** | (2006.01) |
| ***C10B 55/00*** | (2006.01) |
| ***C10B 57/06*** | (2006.01) |

(52) U.S. Cl.

CPC ..... *C10G 9/005* (2013.01); *C10B 55/00* (2013.01); *C10B 57/06* (2013.01); *C10G 2300/107* (2013.01); *C10G 2300/1077* (2013.01); *C10G 2300/308* (2013.01); *C10G 2300/80* (2013.01)

(58) Field of Classification Search

USPC ..... 208/48 Q, 106, 125, 127, 131, 126

See application file for complete search history.

(56) References Cited

U.S. PATENT DOCUMENTS

| | | | | |
|---|---|---|---|---|
| 3,723,291 | A | 3/1973 | Thakker | |
| 4,009,094 | A | 2/1977 | Cole et al. | |
| 4,177,133 | A | 12/1979 | Hayashi et al. | |
| 4,213,846 | A | 7/1980 | Sooter et al. | |
| 4,216,074 | A | 8/1980 | Simone | |
| 4,312,745 | A * | 1/1982 | Hsu et al. | 208/125 |
| 4,455,219 | A | 6/1984 | Janssen et al. | |
| 4,670,133 | A | 6/1987 | Heaney et al. | |
| 4,927,524 | A | 5/1990 | Rodriguez et al. | |
| 5,258,115 | A | 11/1993 | Heck et al. | |
| 5,711,870 | A | 1/1998 | Storm et al. | |
| 7,374,665 | B2 * | 5/2008 | Eppig et al. | 208/131 |
| 2001/0006156 | A1 | 7/2001 | Pereira et al. | |

FOREIGN PATENT DOCUMENTS

| | | |
|---|---|---|
| EP | 0250136 B1 | 2/1992 |
| GB | 1235086 | 2/1970 |

OTHER PUBLICATIONS

Talwani, Mark. "The Orinoco Oil Belt in Venezuela", James A. Baker III Institute for Public Policy Energy Forum, Sep. 2002.*

Siskin et al., "Chemical Approach to Control Morphology of Coke Produced in Delayed Coking", Energy & Fuels, vol. 20, pp. 2117-2124 (2006).

"Emissions From Delayed Cokers", Industry Professionals for Clean Air, pp. 2-5 (2009).

PCT/US2010/041291, PCT International Search Report, Form PCT/ISA/210, dated Dec. 28, 2010, 3 pgs.

PCT/US2010/041291, PCT Written Opinion of the International Searching Authority, Form PCT/ISA/237, dated Dec. 28, 2010, 6 pgs.

Talwani, "The Orinoco Heavy Oil Belt in Venezuela (or Heavy Oil to the Rescue?)", The James A. Baker III Institute for Public Policy of Rice University, Energy Study: Latin America, Sep. 2002, pp. 1-34.

* cited by examiner

*Primary Examiner* — Renee E Robinson

(74) *Attorney, Agent, or Firm* — Glenn T. Barrett; Malcolm D. Keen

(57) ABSTRACT

The morphology of petroleum cokes produced by the delayed coking of feeds produced from extra-heavy crude sources such as those from the Venezuela Orinoco Heavy Oil Belt can be controlled to produce a less dense coke which is less likely to inflame in the coke pit or in subsequent handling. An aqueous solution of an alkali metal or alkaline earth metal carbonate salt when added to a feed of this type which would normally produce a dense coke product is effective to produce a quenchable coke product of lower density and higher porosity, usually in compact, granular form permitting it to be readily discharged from the drum.

22 Claims, 6 Drawing Sheets

DELAYED COKING PROCESS

CROSS REFERENCE TO RELATED APPLICATION

This invention relates and claims priority to U.S. Provisional Patent Application No. 61/270,595 filed on Jul. 10, 2009.

FIELD OF THE INVENTION

The present invention relates to a delayed coking process and more particularly to a delayed coking process for making a coke which does not tend to inflame in the coke pit or during subsequent transport and handling.

BACKGROUND OF THE INVENTION

Delayed coking is one of several types of process used in oil refineries to convert heavy oils to useful lighter products. In delayed cokers, the heavy oil feed is heated in a continuously operating process furnace to effect a limited extent of thermal cracking, after which it enters a large, vertically-oriented cylindrical vessel or coking drum, in which the coking reactions take place. The term "delayed" coker refers to the fact that the coking reactions do not take place in the furnace, but rather are delayed until the oil enters the coke drum. In the coke drum, large oil molecules are further thermally cracked to form additional lighter products and residual coke, which fills the vessel. The lighter hydrocarbons flow out of the drum as vapor and are further processed into fuel products. Gradually the coke accumulates in the drum until it is almost filled with coke. When the drum is nearly filled, the hot oil from the furnace is directed to a clean coke drum, while the full one is decoked. The decoking cycle involves cooling and depressuring the drum, purging it with steam to remove residual hydrocarbon vapor, opening up the top and bottom heads (closures) on the drum and then using high pressure water lances or mechanical cutters to remove the coke from the drum. The coke falls out the bottom of the drum into a pit, where the water is drained off and conveyers take the coke to storage or rail cars. The drum is then closed up and is ready for another coking cycle.

The feedstocks for delayed cokers are typically the heaviest (highest boiling) fractions of crude oil that are separated in the crude fractionation unit, normally comprising an atmospheric distillation tower and vacuum tower. The nature of the coke formed is highly dependent on the characteristics of the feedstock to the coker as well as upon the operating conditions used in the coker. Although the resulting coke is generally thought of as a low value by-product, it may have some value, depending on its grade, as a fuel (fuel grade coke), electrodes for aluminum manufacture (anode grade coke). Generally, the delayed coker is considered to produce three types of coke that have different values, appearances and properties. Needle coke, sponge coke, and shot coke are the most common. Needle coke is the highest quality of the three varieties which commands a premium price; upon further thermal treatment, needle coke has high electrical conductivity (and a low coefficient of thermal expansion) and is used to make the electrodes in electric arc steel production. It is low in sulfur and metals and is frequently produced from some of the higher quality coker feedstocks that include more aromatic feedstocks such as slurry and decant oils from catalytic crackers and thermal cracking tars. Typically, it is not formed by coking of resid type feeds. Sponge coke, a lower quality coke, is most often formed in refineries from lower quality refinery coker feedstocks having significant amounts of asphaltenes, heteroatoms and metals. If the sulfur and metals content is low enough, sponge coke can be used for the manufacture of anodes for the aluminum industry. If the sulfur and metals content is too high for this purpose, the coke can be used as fuel. The name "sponge coke" comes from its porous, sponge-like appearance. Conventional delayed coking processes, using the vacuum resid feedstocks, will typically produce sponge coke, which is produced as an agglomerated mass that needs an extensive removal process including drilling and water-jet technology.

Shot coke is considered the lowest quality coke. The term "shot coke" comes from its spherical or ovoidal shape ball-like shape, typically in the range of about 1 to about 10 mm diameter. Shot coke, like the other types of coke, has a tendency to agglomerate, especially in admixture with sponge coke, into larger masses, sometimes larger than a foot in diameter. This can cause refinery equipment and processing problems. Shot coke is usually made from the lowest quality high resin-asphaltene feeds and makes a good high sulfur fuel source, particularly for use in cement kilns and steel manufacture. There is also another coke, which is referred to as "transition coke" and refers to a coke having a morphology between that of sponge coke and shot coke. For example, coke that has a mostly sponge-like physical appearance, but with evidence of small shot spheres beginning to form as discrete shapes. The term "transition coke" can also refer to mixtures of shot coke bonded together with sponge coke.

Another type of coke sometimes encountered is generally referred to as "dense coke" by reason of its high density. It results from using very low gravity (heavy) feeds such as those from tar sands and heavy oil crudes such as those from the Orinoco Heavy Oil Belt in Venezuela. These dense cokes are difficult to process: their weight imposes additional stresses on the coker drum, they are hard to cut out of the drum and do not readily form particles which can easily be handled—frequently they form large, heavy, boulder-like lumps. A particular problem is that their density does not make them amenable to quenching in the manner of shot coke or even sponge coke. The surface area of shot coke makes it possible for the coke to take up water during the quench phase of the cycle so that it cools off relatively uniformly; conversely, the small size of the shot coke particles makes it possible, in principle at least, to quench this product in an acceptably short period of time. If, however, the process has resulted in a combination of coke morphologies in the drum with more than one type of coke product present, the quenching may be non-uniform and eruptions and discharges may occur when the drilling is commenced or the coke discharged through the bottom header. The dense cokes produced from the very heavy oils are particularly troublesome in this respect since their heavy, dense, non-porous nature tends to prevent the quench water from penetrating the coke mass well so that the problems resulting from slow quenching tend to be more frequently encountered, particularly as more and more heavy crude oils are refined to meet demand for fuel products. Unquenched coke presents a particular hazard since it may result in spontaneous coke pit fires and, when loaded onto barges, coke barge fires. This problem is exacerbated by the fact that the heavy oils feeds which from the dense cokes produce larger proportions of coke than many other feeds, so aggravating both the extent and severity of the problem.

Since a quenchable coke will cool more evenly than dense, low porous coke morphologies it would be desirable to have the capability to produce a coke product from the heavy oils that can be cooled and quenched in the delayed coker drum, in order to avoid or minimize hot drums and coke fires.

SUMMARY OF THE INVENTION

We have now found that certain alkaline additives can be used to control the morphology of petroleum cokes produced from heavy oil feeds produced from extra-heavy crude sources. According to the present invention a heavy oil feed which would normally produce a dense coke product is subjected to delayed coking in the presence of an aqueous solution of an alkali metal or alkaline earth metal carbonate salt. The coke product resulting from this use of alkaline additive in the process is notable for its lower density and higher porosity relative to the dense coke product which would be obtained in the absence of the additive; moreover, it is more friable and usually is in compact, granular form permitting it to be discharged from the drum without difficulty. The lower density coke is more amenable to uniform quenching in the drum and so can be cut and discharged with a reduced risk of eruptions and a reduced risk of fires in the coke pit or when the coke is subsequently handled and transported.

DRAWINGS

DETAILED DESCRIPTION

Figure 1:
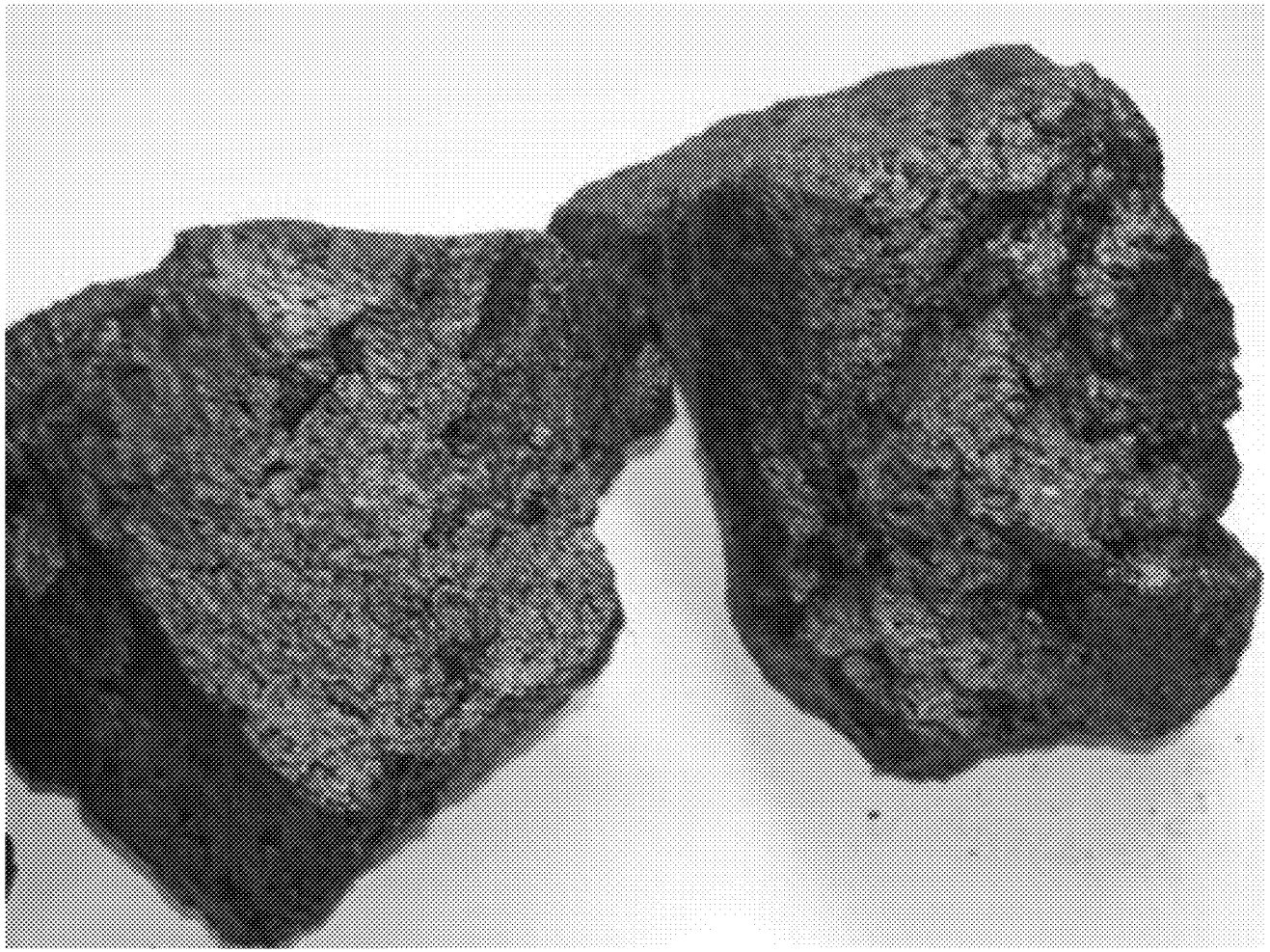
FIG. 1 is an optical image of the dense coke produced from processing a vacuum resid derived from a synthetic crude from the Morichal sand reservoirs in a delayed coker unit.

The present invention is directed to dealing with the problems which are encountered in the delayed coking of heavy oil feeds which are produced from extra heavy crude sources. Crude sources of this type are being increasingly used in fuels production as the supplies of lighter, easier-to-process crudes are becoming either shorter, more costly or are being used for more valuable purposes. Crude sources of this kind include the tar sands such as the tar sands, tar pits and pitch lakes of Canada (Athabasca, Alta.), Trinidad, Southern California (La Brea (Los Angeles), McKittrick (Bakersfield, Calif.), Carpinteria (Santa Barbara County, California), Lake Bermudez (Venezuela) and similar deposits in Texas, Peru, Iran, Russia and Poland. Of these, the most significant commercially at the present time is the tar sand belt in Venezuela, especially the Orinoco Tar Belt and the Cerro Negro part of the Belt. The crudes from these oilfields are generally characterized by a low API gravity (low hydrogen content), typically in the range of 5-20° API and in many cases from 6 to 15° with some ranging from 8 to 12° API. Examples include the 8.5° API Cerro Negro Bitumen and crudes from the Morichal (8-8.5° API), Jobo (8-9° API), Pilon (13° API) and Temblador (19° API) oilfields. These extra-heavy oils are normally produced by conventional enhanced recovery methods including alternated steam soaking. The heaviest types of these oils such as the Morichal and Jobo crudes are normally diluted at the well-head with gasoil or lighter crudes or processed petroleum fractions such as heavy naphthas, distillates or thermal cracking products including coker gas oils and coker naphthas, in order to reduce their high viscosity and facilitate their transport by pipeline and to attain their sale specification as synthetic crudes, for instance, as the commercial blend known as the Morichal Segregatio (12.5° API) or the blend of Pilon and Temblador sold as Pilon Segregation (13.5° API) or the Pilon blend in which all the crudes produced from the region are diluted to 17° API with lighter crudes from the adjacent San Tome area. Fractions which can be used as diluents may themselves be produced by thermal cracking processes such as visbreaking, delayed coking.

These crudes may be processed by conventional refining techniques into the desired higher value hydrocarbon products. Normally processing, which be carried out on the diluted synthetic crude stocks, will include desalting followed by atmospheric and vacuum distillation to remove light ends including the diluents, to leave a high boiling resid fraction which can then be further processed to produce more light products. Delayed coking and fluid coking are particularly apt for converting these residual fractions since their high CCR will normally deposit excessive coke in catalytic cracking operations unless specifically designed for resid cracking. When heavy oil feeds derived from these crude sources are subjected to delayed coking in commercial size units (typically in drums over 8 m in diameter above the bottom conical section), a large volume of very dense, hard, non-porous coke results under normal coking conditions, e.g with moderate pressures over about 100 or 150 kPag (15 or 22 psig) and temperatures of about 400-500° C. (750 to 930° F.), e.g. 415° C. (780° F.) in the drum. The coke density of the mass in the drum is typically in the range of 1040-1120 kg/m$^3$ (65-70 lb/ft$^3$) compared with typical delayed coker coke densities of 830-930 kg/m$^3$ (52-58 lb/ft$^3$) for both sponge coke and shot coke. As noted above, the dense, hard masses that these cokes from are difficult to quench adequately and to remove from the drum and even when removed, present a continuing fire hazard until a long cooling period has elapsed. The problem is particularly notable when processing residual feeds derived from the lowest API crudes, especially those with an API density below 10° and most notably with feeds derived form crudes of 9° API or less such as feeds from the Morichal and Cerro Negro crude sources, both in the range of 8-8.5° API.

The delayed coker feeds from the very heavy crude sources will be residual types feeds, that is, with a minimal content of components boiling below about 500° C.; generally the feed will have an initial boiling point in the range of 525-550° C. (975-1025° F.) or higher, an API gravity of about 20° or less and a Conradson Carbon Residue content of about 20 to 40 weight percent. In most cases, the coker feed will be a vacuum resid produced from one the very heavy crude sources by the normal process including desalting, atmospheric distillation, vacuum distillation.

The feed will typically be subjected to delayed coking by heating it to a temperature from about 480° C. to about 520° C. in a fired heater, usually a tubular furnace, after which it is discharged to the coking drum through a transfer line, entering the drum through a an inlet in the base of the drum. Pressure in the furnace is typically about 350 to 3500 kPag (about 50 to 550 psig) but pressure in the drum is usually relatively low, typically from about 100 to 550 kPag (about 15 to 80 psig) to allow volatiles to be removed overhead. Typical operating temperatures in the drum will be between about 410° and 475° C. The hot feedstock continues to thermally crack over a period of time (the "coking time") in the coker drum, liberating volatiles composed primarily of volatile hydrocarbon products that continuously rise through the coke mass and are collected overhead. The volatile products are sent to a coker fractionator for distillation and recovery of coker gases, gasoline, distillate, light gas oil, and heavy gas oil fractions. A portion of the heavy coker gas oil present in the product stream can be captured from the fractionator for recycle and combined with the fresh feed (coker feed component), thereby forming the coker heater or coker furnace charge. In most cases, the fresh heavy oil feed is introduced into the coker unit through the coker fractionator, also referred to as the combination tower from its function to fractionate the products from the drum as well as stripping light ends remaining in the feed. The fresh feed normally enters the tower at a level above that of the drum vapors to provide for direct heat exchange between the coking vapors and the incoming feed. Low drum pressures and low recycle volumes are preferred for optimal operation with the heavy feeds: pressures below about 150 kPag (about 22 psig) are preferred although may existing units will be run at pressures in the range of 150 to 350 kPag (about 22 to 50 psig). Recycle may be reduced to zero if furnace operation permits since the function of recycle is generally to inhibit furnace fouling; with the present feeds recycle ratios (recycle:fresh feed) of from 1:20 to 1:4 will normally be suitable.

The feed to the coker unit is subjected to treatment with and aqueous solution of one or more alkaline, metal-containing additives. In order to promote the formation of a coke product which is reasonably uniform, the additives should be dispersed uniformly into the resid. The temperature at which the additive is mixed with the resid will depend on the point at which the additive is injected and this may be upstream of the furnace, at the furnace outlet, in the transfer line to the drum, into the drum itself, or in multiple locations. So, broadly stated, the temperature will typically be from about 70 to 500° C. The additive is preferably injected into the resid downstream of the furnace and upstream of the drum, but could be injected at other locations that allow the additive to mix with the resid. The introduction point of the additive solution could, for example, alternatively be, at the discharge of the furnace feed charge pumps, or near the exit of the coker transfer line. In view of the viscosity of the feed, it will normally be a temperature at which it is in a condition adequately fluid for mixing with the additive solution, a condition which will be met at all point downstream of the combination tower. Such temperatures will typically be from about 70 to 500° C., usually from about 185 to 500° C.

The alkaline additives which we have found to be useful in varying degrees are the carbonates of alkali metals, normally of sodium or potassium. Sodium carbonate has been found to increase the coke make (so reducing liquid yield) and for this reason, preference is given to potassium carbonate. Sodium carbonate also tends to increase foaming in the drum, another factor in reducing the throughput (feed tonnes per day) since the drum cannot be filled as high when foaming takes place.

The rate of additive introduction can be adjusted according to the nature of the resid feed to the coker. Feeds that are on the threshold of producing granular coke may require less additive than those which are farther away from the threshold. Additive injection rates of 400 or 500 ppm to 1200 ppm of metal are typical, but will depend on the composition and other chemical and physical properties of the resid being converted and can therefore typically range from 300-3,000 wppm although more than 2,000 ppm will not be favored for economic reasons. Favorable reductions in the coke density, to values below 1,000 kg/m$^3$ can be achieved with addition rates of at least 800 and preferably at least 900 or 1,000 ppm metal relative to the resid feed. The range of 800 to 1200 ppm, preferably 1,000 to 1,200 ppm represents a highly useful range for optimal density reduction at acceptable cost.

The carbonate additive is typically added to the coker feed in the form of an aqueous solution. The concentration of the carbonate additive in the water will typically be from 5 to 50 w/w percent although concentrations up to saturation may be used if compatible with equipment. Concentrations of 20 to 40 w/w percent are normally convenient. The aqueous carbonate solution may itself be emulsified, slurried or dispersed into a hydrocarbon carrier such as a naphtha or middle distillate fraction such as kerosene or diesel or gas oil in order to facilitate uniform mixing into the heavy oil coker feed. Depending on the ratios of the water and carrier, a water-in-oil or oil-in-water emulsion may be formed, e.g. mixing a $K_2CO_3$ solution with a larger volume of naphtha will produce a naphtha continuous phase with drops of the $K_2CO_3$ solution. Shaker tests have shown that mixing a potassium carbonate solution with naphtha produced a naphtha continuous phase with drops of the carbonate solution dispersed throughout the naphtha. Minor quantities of a surfactant may be added to promote mixing of the aqueous solution into hydrocarbon carriers such as naphtha or kerosene fractions. Alternatively, the solution may be mixed with a mutual solvent as carrier such as an alcohol either as such or also with the hydrocarbon carrier.

The water in the solution tends to vaporize when injected into the heated resid along with any volatile carrier, possibly resulting in a partial change in the character of the coke, rendering it less hard and more granular, but it does not result in itself in a density decrease similar to that which is obtained when the carbonate additive is used. If the additive solution and, optionally, the carrier, is added after the furnace, a decrease in the temperature of the stream entering the coker drum is achieved. Simulation predicts a nominal decrease of about 5-8° C. (10-15° F.) between the furnace outlet and drum inlet in addition to the normally expected value. Smaller decreases are however normally observed in actual operation, typically of the order of 5° C. (9° F.) when using the amount of additive solution normally used to produce a quenchable coke, typically about 0.5-2 v/v percent, based on the volume of the feed, in most cases, 0.5 to 2 v/v percent, normally with a similar volume of the carrier when used. Larger decreases in the temperature of the stream entering the drum may be achieved with the use of greater volumes of solution or carrier: more dilute solutions may be used to achieve a controlled decrease in drum inlet temperature with a correspondingly decreased rate of coking in the drum which may possibly to contribute to the change in the character of the coke. Additional water and carrier may be injected into the stream after the furnace outlet to effect a further control of the drum inlet temperature. Thus, injection of the water and/or the volatile liquid into the feed downstream of the furnace provides a way to control the drum inlet temperature and the rate of coking in the drum independently of the temperature used in the heater.

The additive can be injected into the resid flow through the use of a refractory lined quill or by other suitable techniques. A coke drum bottom inlet injector can, for example, installed to produce an unobstructed jet within the coke drum. High energy mixing or use of static mixing devices in the transfer line or upstream of the heater may be employed to assist in dispersal of the additive fluid but normally will be found more troublesome than a simple feed quill after the heater. Uniform dispersal of the emulsion quench liquid species into the resid feed is desirable to avoid heterogeneous areas of coke morphology formation: locations in the coke drum where the coke is substantially free flowing and other areas where the coke is substantially non-free flowing are not wanted.

When the additive solution is introduced into the feed in the inlet tract to the furnace or in the transfer line between the furnace and the drum, the injection nozzle or quill should preferably be configured to deliver the solution to the center line flow of the pipe/transfer line. In view of the high temperatures prevailing in the transfer line, the injection nozzle or injection quill is preferably provided with an insulating thermal sleeve to prevent premature heat transfer to the additive solution with consequent vaporization of the solution within the nozzle, leaving a solid residue of the additive salt in the nozzle.

Figure 2:
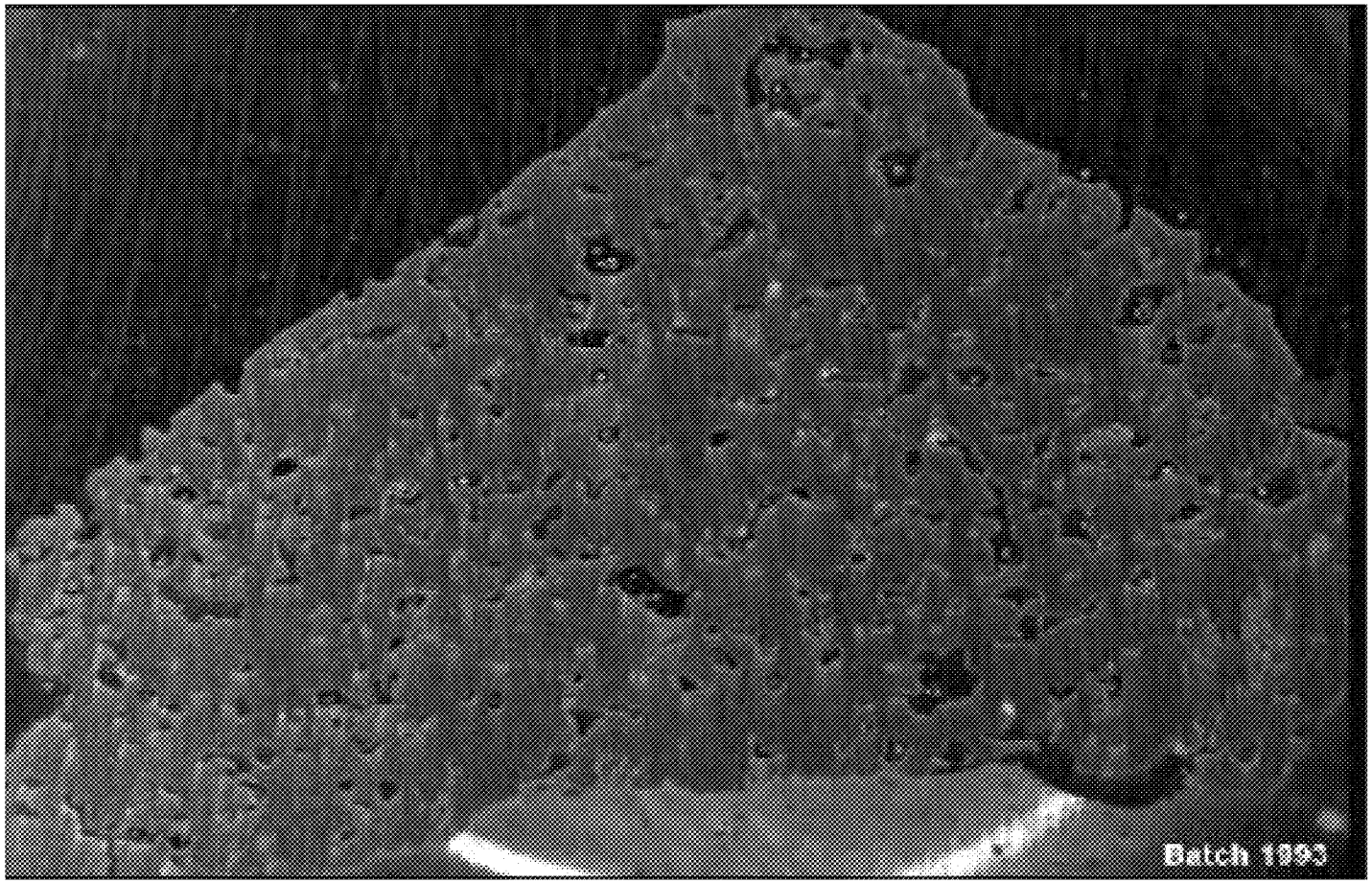
FIG. 2 is an optical micrograph of a dense non-porous coke produced from a vacuum resid derived from a synthetic crude from the Morichal sand reservoirs with no additive.
Figure 3:
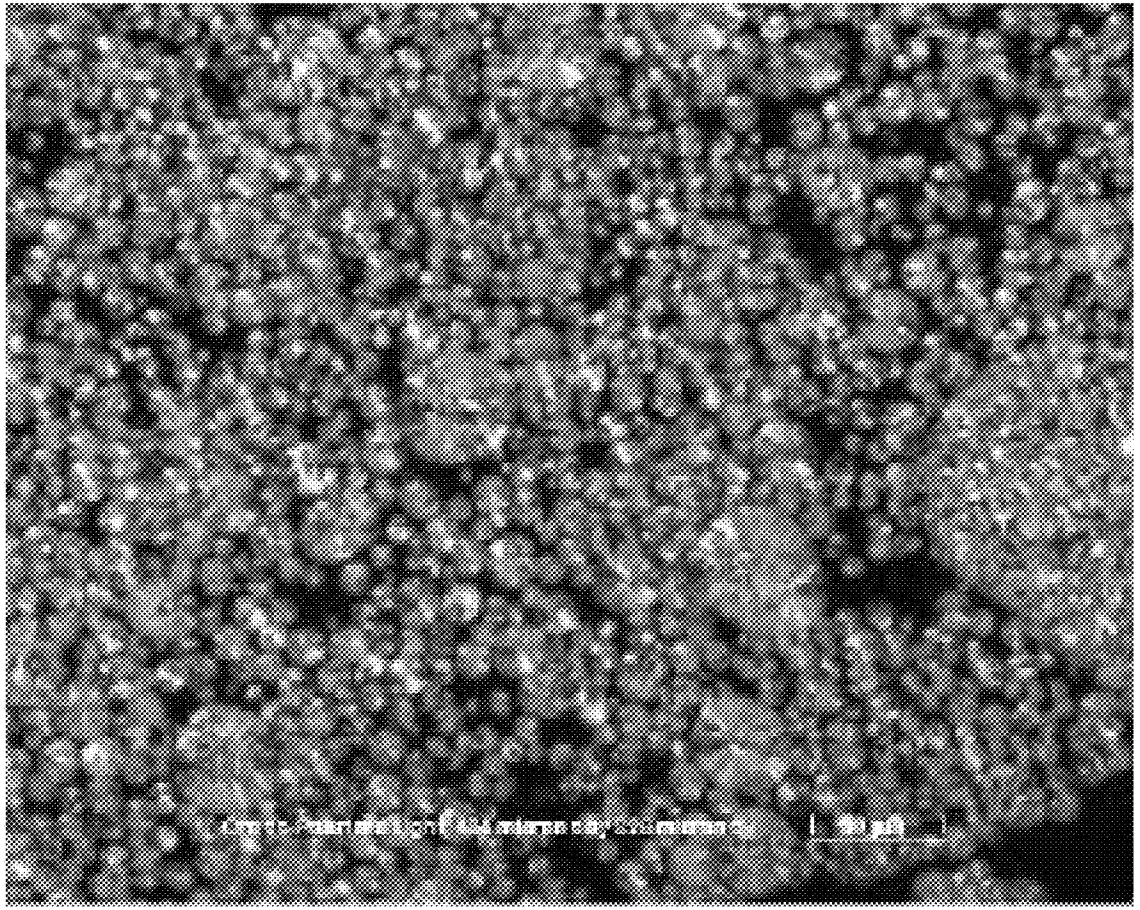
FIG. 3 is an optical photomicrograph under cross-polarized light of a dense non-porous coke produced from a vacuum resid derived from a synthetic crude from the Morichal sand reservoirs with no additive.

The coke which is produced by the use of the carbonate additive with the heavy crude origin feeds is notably different in its characteristics from the coke that is produced by delayed coking in the absence of the additive. FIG. 1 shows the gross form of the conventional dense coke product—large lumps that in some cases, can be as large as boulders when cut from the drum. FIGS. 2 and 3 show micrographs of dense cokes produced without carbonate additive. For a comparison between the dense coke structures shown in of FIGS. 2 and 3 and conventional shot coke and sponge coke, refer to the article by Siskin et al, *Chemical Approach to Control Morphology of Coke Produced in Delayed Coking*, Energy & Fuels, 2006, 2117-2124. The shot cokes shown in FIGS. 3 and 4B of the article show a relatively uniform, fine pattern of small voids in a mosaic structure with small anisotropic flow domains (2-10 μm, 2-3 μm respectively) and the sponge coke of FIG. 4A has larger interstices and flow domains in the 10-50 μm size range. The dense coke of FIG. 2 has a structure in which the voids are small and not highly numerous. By contrast, the coke produced with the additive is granular, less dense and almost friable. It breaks up readily when quenched and cut in the drum and forms a free-flowing product which can easily be handled and transported. Importantly, its reduced density allows it to be effectively quenched in the drum within an acceptable time span, that is, in a time comparable to that needed by a sponge coke in the same drum. This, in turn makes it possible to discharge the coke with a greater assurance that coke pit fires will not ensue and that the coke will not subsequently inflame.

Figure 4:
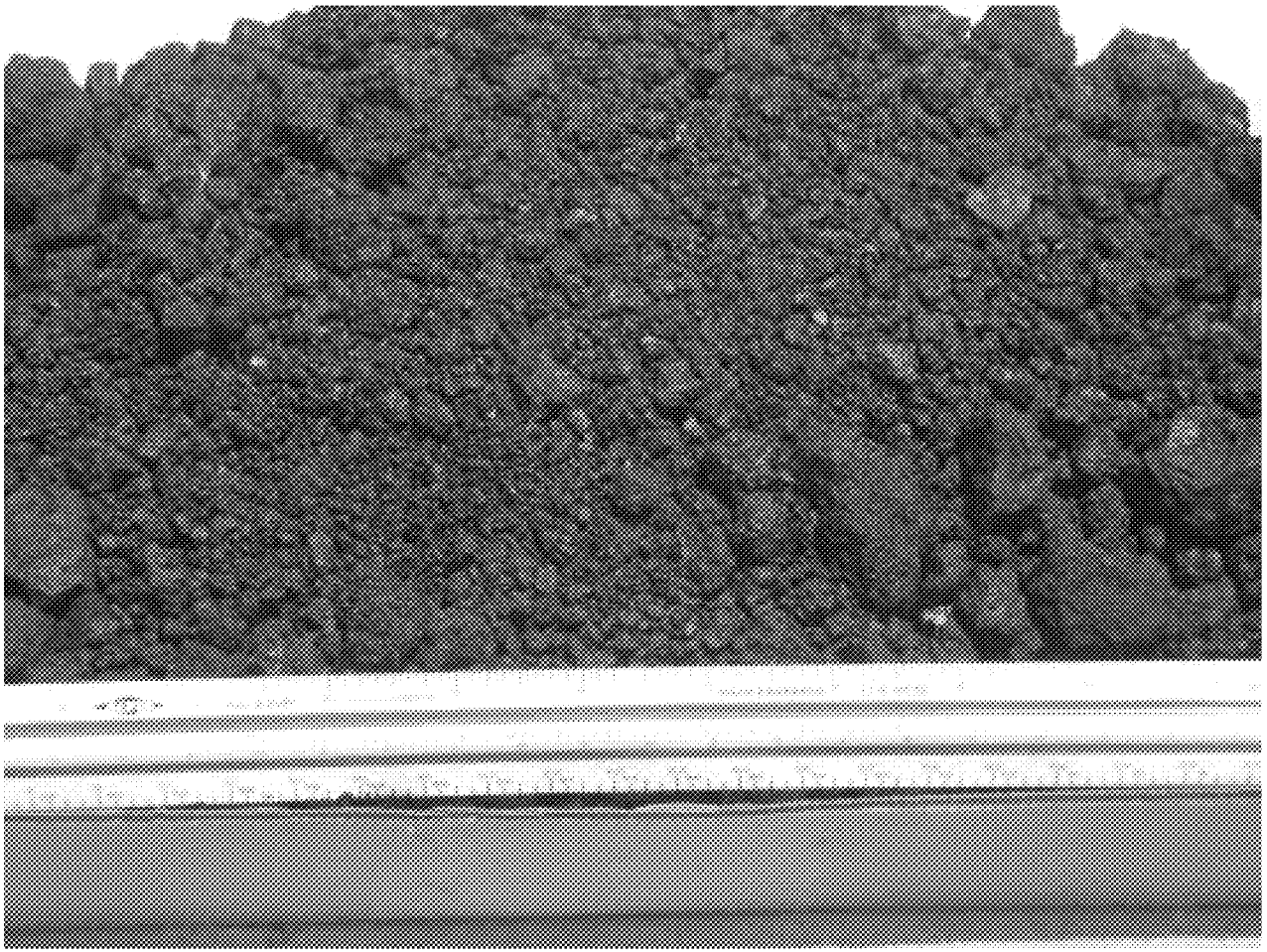
FIG. 4 is an optical image of the coke produced from processing a vacuum resid derived from a synthetic crude from the Morichal sand reservoirs in a delayed coker unit using an alkaline additive.

FIG. 4 shows an image of a typical coke product produced by delayed coking of a vacuum resid from Morichal synthetic crude with potassium carbonate added to the feed, as discharged from the drum. As can be seen, it is granular in texture with particles ranging from about 2 to 20 mm in size and is flowing, making it adaptable to bulk handling techniques. Its bulk density is typically less than 1,000 kg/m$^3$ (62 lbs/ft$^3$), (i.e. relative density less than 1), usually in the range 900-1000 kg/m$^3$ (56-62 lbs/ft$^3$), and in most cases normally ranging from 920 to 950 kg/m$^3$ (57-59 lbs/ft$^3$). The volume of coke produced in the process relative to volume of feed is typically at least 0.30 m$^3$ coke/m$^3$ feed (1.97 ft$^3$ coke/bbl feed) and may range as high as 0.40 m$^3$ coke/m$^3$ feed (2.25 ft$^3$ coke/bbl feed).

Figure 5:
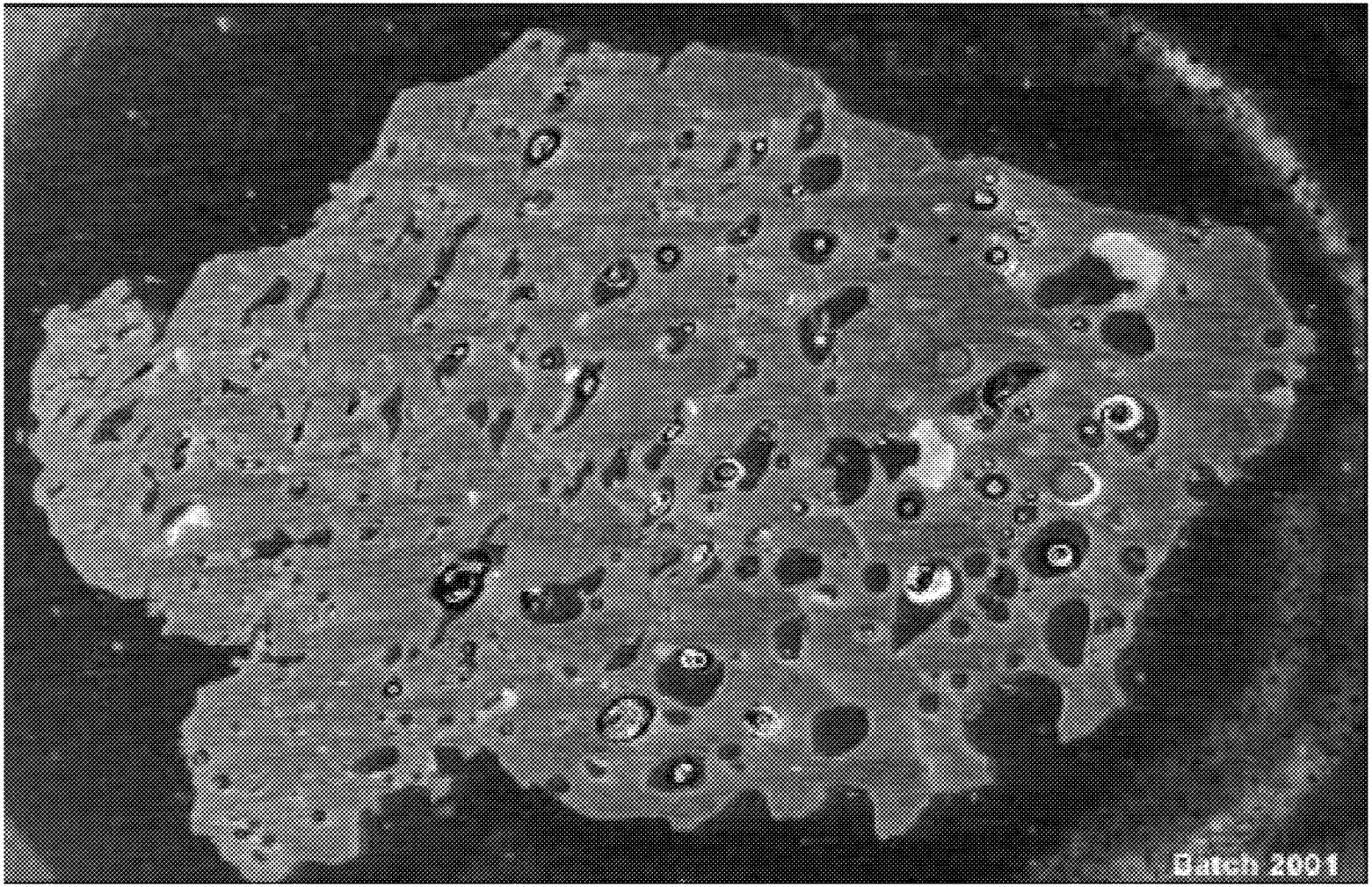
FIG. 5 is an optical image of coke produced from a vacuum resid derived from a synthetic crude from the Morichal sand reservoirs after treatment with potassium carbonate salt as additive.
Figure 6:
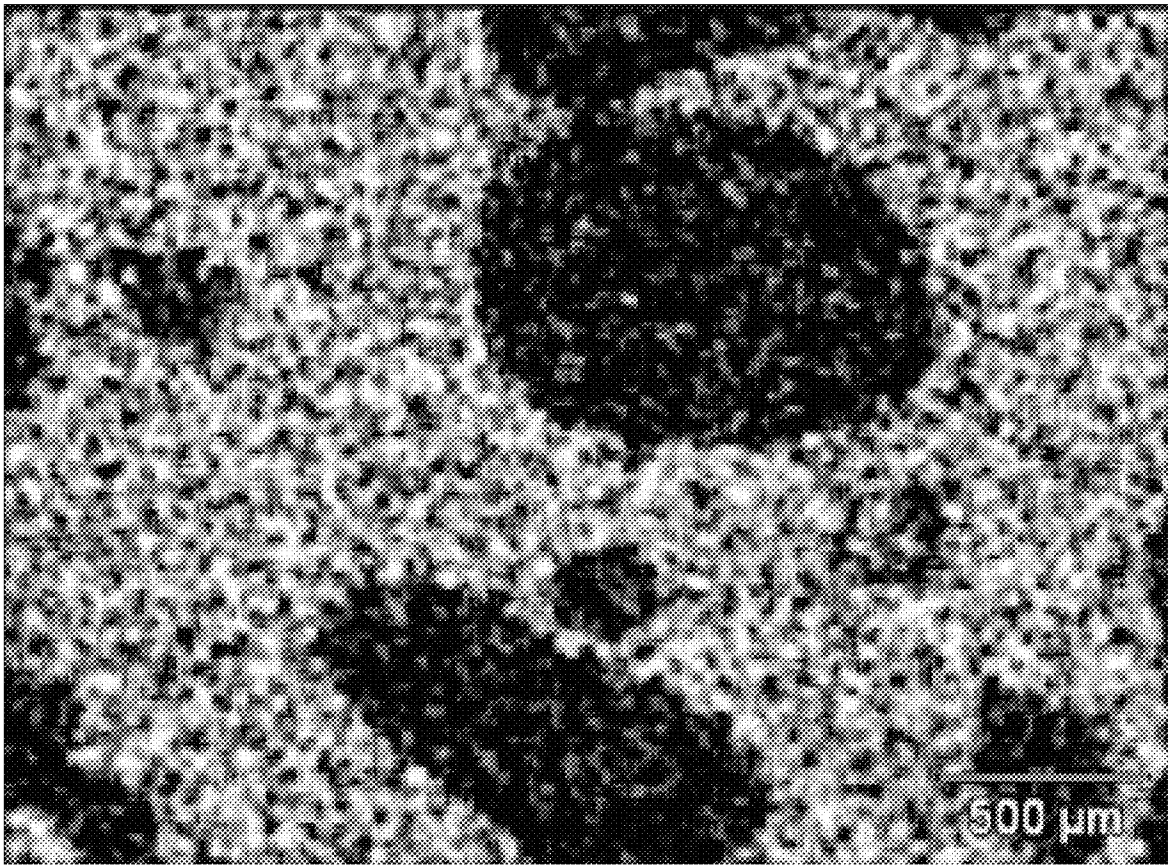
FIG. 6 is a photomicrograph showing uniform distribution of potassium in the coke of FIG. 5 by SEM X-ray data

FIG. 5 shows the microstructure of the coke: the larger void spaces should be noted, giving rise to the lower bulk density. FIG. 6 shows the distribution of the potassium throughout the mass (by SEM X-ray), indicating that a uniform distribution of the additive solution into the heated resid was achieved. The internal voids in the coke enable the quench water introduced into the drum to penetrate the coke mass much more effectively than is the case with the dense coke produced without the additive and so the coke can be reliably cut and discharged from the drum following a normal quench operation with a reduced risk of eruptions and pit fires.

It is noted that the improved coke qualities are not attributable to the use of the water alone: although it might be expected that the water would tend to vaporize on meeting the heated oil and reduce the density of the coke, it has been found that the density decrease achieved using water alone (no additive) is not as great as when the alkaline additive is used although the product is more granular than a conventional dense coke.

EXAMPLES

General Procedure

An Orinoco Heavy Oil belt derived resid was processed by delayed coking using an 8 m (26 ft) diameter commercial coke drum with a pre-heating zone temperature of 285-295° C., a furnace outlet temperature of 486° C. and a coking drum temperature of 400-415° C.

Example 1

When no $K_2CO_3$ and no water were added to the feed in the transfer line, a fairly dense coke with observed jagged edges was produced. The coke density was 1,041 kg/m$^3$ and the volume of coke produced relative to the volume of resid feed was measured at 2.6 m$^3$ coke/m$^3$ feed (1.94 ft$^3$ coke/bbl feed). The coke was quite non-porous when observed at 60× magnification as shown in FIG. 2.

This run is summarized in Table 1 below as Batch No. 1993.

Example 2

The Orinoco resid was subjected to delayed coking with equal volumes of water and naphtha (1.3 vol. percent total relative to feed) added to the feed in the transfer line after the furnace. This resulted in a unique and unexpected granular coke that was mechanically softer than the dense coke of Example 1 although the coke density remained at 1,041 kg/m$^3$. The coke volume relative to feed was 0.30 m$^3$ coke/m$^3$ feed (2.2 ft$^3$ coke/bbl feed). The coke was more porous when observed at 60× magnification as shown in FIG. 5, appeared to quench better and cut much more quickly. The uniform distribution of potassium in the coke was confirmed by SEM X-ray data at 50 micron resolution as shown in FIG. 6.

This run is summarized in Table 1 below as Batch No. 2005.

Example 3

The Orinoco resid was subjected to delayed coking with the addition of a potassium carbonate solution (47 percent by weight $K_2CO_3$) to the feed in the transfer line with equal volumes of additional water and naphtha also added in the transfer line. The additive solution, additional water and naphtha were added at the rates of 0.3, 0.3 and 0.6 vol. percent relative to the feed to give a nominal 1200 wppm potassium, based on resid. The coke produced in this way was a unique and unexpected granular coke that was mechanically softer. The coke density was 929 kg/m$^3$ and the volume relative to the volume of resid feed was 0.35 m$^3$ coke/m$^3$ feed (2.2 ft$^3$ coke/bbl feed). The coke was more porous when observed at 60× magnification as shown in FIG. 5, appeared to quench better and cut much more quickly. The uniform distribution of potassium in the coke was confirmed by SEM X-ray data at 50 micron resolution as shown in FIG. 6.

This run is summarized below as in Table 1 Batch No. 2004.

Examples 4-20

Additional delayed coking runs were carried out in the same delayed coker unit using similar conditions both with and without additions of carbonate additive. When used, the potassium carbonate was added as a 47 wt. percent solution in water and this was added to the transfer line after the furnace together with additional water and naphtha. The results are summarized in Table 1 below and show that the addition of the carbonate additive in appropriate proportions produces a notable decrease in density of the coke product.

TABLE 1

Delayed Coking of Heavy Oil Resids

| Batch | Description (1) | Feed Rate, $m^3$/hr. | Additive Soltn, l/hr. | Water, l/hr. | Naphtha, l/hr. (2) | Coke density, kg/$m^3$ | ΔT, ° C. (3) | Coke vol/ Feed vol., $m^3/m^3$ |
|---|---|---|---|---|---|---|---|---|
| 1993 | Baseline Comparison | 141 | | | | 1041 | 15 | 0.31 |
| 2005 | 12 hour no additive | 150 | 0 | 1000 | 1000 | 1041 | 21 | 0.30 |
| 2007 | 12 hour no additive | 155 | 0 | 1000 | 1000 | 1041 | 21 | 0.32 |
| 1995 | Additive (250 ppm) | 145 | 73 | 227 | 320 | 1041 | 16 | 0.29 |
| 1996 | 9 hour 250 ppm | 153 | 73 | 227 | 320 | 1041 | 15 | 0.30 |
| 1997 | 9 hour 450 ppm | 156 | 145 | 454 | 635 | 1041 | 16 | 0.30 |
| 1998 | 9 hour 450 ppm | 155 | 145 | 454 | 635 | 1041 | 20 | 0.31 |
| 1999 | 11 hour 450 ppm | 159 | 175 | 454 | 635 | 1041 | 20 | 0.29 |
| 2000 | 12 hour 600 ppm | 149 | 250 | 454 | 635 | 1041 | 17 | 0.26 |
| 2001 | 12 hour 1200 ppm | 135 | 500 | 500 | 1000 | 929 | 19 | 0.36 |
| 2002 | 12 hour 1200 ppm | 155 | 500 | 500 | 1000 | 929 | 19 | 0.35 |
| 2003 | 12 hour 1200 ppm | 154 | 500 | 500 | 1000 | 929 | 19 | 0.36 |
| 2004 | 12 hour 1200 ppm | 159 | 500 | 500 | 1000 | 929 | 22 | 0.35 |
| 2006 | 12 hour 1200 ppm | 158 | 500 | 500 | 1000 | 929 | 21 | 0.32 |
| 2008 | 12 hour 1200 ppm | 148 | 500 | 500 | 1000 | 929 | 20 | 0.35 |
| 2009 | 12 hour 1200 ppm | 162 | 500 | 500 | 1000 | 929 | 21 | 0.33 |
| 2010 | 12 hour 1200 ppm | 162 | 500 | 500 | 1000 | 929 | 19 | 0.34 |
| 2011 | 12 hour 1200 ppm | 166 | 500 | 500 | 1000 | 929 | 21 | 0.30 |
| 2012 | 12 hour 1200 ppm | 169 | 500 | 500 | 1000 | 929 | 19 | 0.33 |

Notes:
(1) Additive quantities nominal
(2) Naptha API = 63.8
(3) Coil Outlet Temp. − Drum Inlet Temp.

The invention claimed is:

1. A delayed coking method comprising:

(a) heating a petroleum resid feed derived from an Orinoco Tar Sand Belt heavy crude having an initial boiling point of at least 525° C., a gravity of 5 to 9° API, and a Conradson Carbon Residue of 20 to 40 percent, to a coking temperature up to 500° C. and at a pressure of 100 to 550 kPag coking drum pressure;

(b) injecting an aqueous solution of a basic additive comprising a carbonate salt of an alkali metal or alkaline earth metal into the resid in an amount of 300 to 3000 ppmw metal in the additive relative to the resid;

(c) coking the resid in a delayed coking drum from which coking vapor products are collected and a coke product is formed as a mass in the drum;

(d) quenching the coke mass in the drum to produce a solid coke product of lower density and higher porosity than in the absence of the basic additive.

2. A process according to claim 1 in which the amount of the basic additive is from 800 wppm to 1500 wppm metal in the additive relative to the resid).

3. A process according to claim 1 in which the amount of the basic additive is from 1,000 wppm to 1200 wppm metal in the additive relative to the resid.

4. A process according to claim 1 in which the resid feed comprises a vacuum resid derived from an Orinoco Heavy Oil crude.

5. A process according to claim 1 in which the resid feed comprises a vacuum resid derived from an Orinoco Tar Sand Belt heavy crude having a gravity of 8 to 9° API.

6. A process according to claim 1 in which the additive comprises potassium carbonate.

7. A process according to claim 1 in which the aqueous solution is dispersed into a hydrocarbon before being added to the resid feed.

8. A delayed coking method comprising:

(a) heating a petroleum resid feed derived from an Orinoco Tar Sand Belt heavy crude having a gravity of 5 to 9° API in a first heating zone and a Conradson Carbon Residue of 20 to 40 percent, to a temperature at which the resid is a pumpable liquid;

(b) heating the resid further in a furnace to a coking temperature of up to 500° C.;

(c) conducting the heated resid from the furnace to a delayed coking drum from which vapor products are collected overhead and a coke product is formed as a mass in the drum at a pressure of 100 to 550 kPag drum pressure;

(d) injecting an aqueous solution of a basic additive comprising a carbonate salt of an alkali metal or alkaline earth metal into the resid before or after step (b) or (c), in which the amount of the basic additive is from 300 wppm to 3000 wppm metal in the additive relative to the resid;

(e) quenching the coke mass in the drum to produce a solid coke product of lower density less than 1,000 kg/m$^3$ and higher porosity than in the absence of the basic additive.

9. A process according to claim 8 in which the temperature of the drum is from 400 to 500° C.

10. A process according to claim 8 in which the amount of the basic additive is from 800 wppm to 1200 wppm metal in the additive relative to the of resid.

11. A process according to claim 8 in which the resid feed comprises a vacuum resid derived from an Orinoco Heavy Oil crude.

12. A process according to claim 11 in which the resid feed comprises a vacuum resid derived from an Orinoco Tar Sand Belt heavy crude having a gravity of 8 to 9° API.

13. A process according to claim 8 in which the additive comprises potassium carbonate.

14. A process according to claim 8 in which the aqueous solution is dispersed into a hydrocarbon before being added to the resid feed.

15. A process according to claim 8 in which the solid coke product comprises a granular coke having a density less than 1,000 kg/m$^3$.

16. A process according to claim 15 in which the solid coke product comprises a granular coke having a bulk density of not more than 950 kg/m$^3$.

17. A delayed coking method to produce a solid delayed coke product using a feed comprising a resid fraction derived from a very heavy oil feed from the Orinoco Heavy Oil Belt and having a gravity of 8 to 9° API and a Conradson Carbon Residue of 20 to 40 percent, which comprises subjecting the feed to delayed coking by:

(a) heating the resid feed in a first heating zone, to a temperature at which the resid is a pumpable liquid;

(b) heating the resid further in a furnace to a coking temperature of up to 500° C. at a pressure of 100 to 550 kPag drum pressure;

(c) conducting the heated resid from the furnace to a delayed coking drum from which vapor products are collected overhead and a coke product is formed as a mass in the drum;

(d) injecting an aqueous solution of a basic additive comprising potassium carbonate into the resid after step (b) in an amount from 800 wppm to 1500 wppm metal in the additive relative to the resid;

(e) quenching the coke mass in the drum to produce a solid coke product having density less than 1,000 kg/m$^3$ and higher porosity than in the absence of the basic additive.

18. A process according to claim 17 in which the solid coke product comprises a granular coke having a bulk density of not more than 950 kg·/m$^3$.

19. A process according to claim 18 in which the aqueous solution is dispersed into a hydrocarbon carrier before being added to the resid feed.

20. A process according to claim 19 in which the hydrocarbon carrier comprises a naphtha.

21. A process according to claim 17 in which the solid coke product comprises a granular coke having a bulk density of 920 to 950 kg/m$^3$.

22. A process according to claim 17 in which the aqueous solution of the potassium carbonate is added into the resid after step (b) in an amount from 1,000 wppm to 1,200 wppm metal in the additive relative to the resid.

* * * * *